US006826864B1

(12) United States Patent
Houtsma

(10) Patent No.: US 6,826,864 B1
(45) Date of Patent: Dec. 7, 2004

(54) FORWARD MOUNTING RAILS

(75) Inventor: Gary Houtsma, Denville, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 64 days.

(21) Appl. No.: 10/249,702

(22) Filed: May 1, 2003

(51) Int. Cl.[7] ..... F41A 15/00
(52) U.S. Cl. ..... 42/90; 42/124; 248/205.1
(58) Field of Search ..... 42/75.02, 85, 90, 42/106, 124, 111; 248/201, 205.1, 298.1

(56) References Cited

U.S. PATENT DOCUMENTS 4,845,871 A * 7/1989 Swan ..... 42/127
5,343,650 A * 9/1994 Swan ..... 42/117
6,381,895 B1 * 5/2002 Keeney et al. ..... 42/124
6,508,027 B1 * 1/2003 Kim ..... 42/124
6,606,813 B1 * 8/2003 Squire et al. ..... 42/90
2003/0101632 A1 * 6/2003 Davenport et al. ..... 42/85
2003/0106252 A1 * 6/2003 Hines ..... 42/90

* cited by examiner

*Primary Examiner*—Michael J. Carone
*Assistant Examiner*—Gabriel Sukman
(74) *Attorney, Agent, or Firm*—Michael C. Sachs; John F. Moran

(57) ABSTRACT

The forward mounting rail system for fire control and other accessories for attachment to automatic and semi-automatic; weapon providing three additional MIL-STD-1913 mounting rails to supplement the one standard MIL-STD-1913 mounting rail currently used on the M249 SAW. The forward mounting rail system for the 5.56 mm M249 Squad Automatic Weapon) consists of a two piece base which attaches directly to the M249 SAW using existing holes in the receiver of the said weapon. The two piece configuration facilitates ease of use and manufacture by reducing the number of parts required to affix the mounting rail on the weapon.

5 Claims, 4 Drawing Sheets

FORWARD MOUNTING RAILS

FEDERAL RESEARCH STATEMENT

The invention described herein may be manufactured, used or licensed by or for U.S. Government purposes without the payment of royalties thereon.

BACKGROUND OF INVENTION

I. Field of Invention

This invention applies to MIL-STD-1913 mounting rails. The present invents relates in particular to providing mounting rails on the forward portion of the 5.56 mm M249 Squad Automatic Weapon.

II. Background of the Invention.

Weapons such as the M249, M240, M16A4 Rifle and M4 Carbine with integral mounting rails for fire control and other devices are proliferating. MIL-STD-1913 mounting rails offer a versatile mounting interface for attaching a wide variety of weapon accessories.

The popularity of the MIL-STD-1913 mounting rail has led to the need for more mounting rail space on each weapon to make room for more and more rail mounted accessories. This lack of mounting surfaces has existed since the advent of MIL-STD-1913.

The M249 as used by the U.S. Military currently has one MIL-STD-1913 mounting rail on top of the feed cover. This single mounting rail provides less than seven (7) inches of mounting rail length, which limits the number of accessories which may be mounted directly to the weapon to typically just the optical sight or night sight. If the machine gun optic was on the weapon, there is no mounting surfaces for an aiming light or combat I.D. system.

A great and still unsatisfied need exists for an additional MIL-STD-1913 mounting rails on the M249 to allow mounting of a variety of weapons accessories used with the M249.

It is therefore an object of the present invention to satisfy the long required need to provide an additional MIL-STD-1913 stable mounting rail for fire control and many other new devices.

It is another object of this invention to capitalize on the existing knowledge of the MIL-STD-1913 mounting rail currently employed in the field.

Yet another object is to provide three or more rails for multiple mounting devices to the M249. The forward rails provide multiple mounting surfaces for accessories such as laser pointers combat I.D. at the same time.

The aforesaid objectives can be achieved individually and in combination and it is intended that the invention be construed as requiring that two or more of said objects be combined.

SUMMARY OF INVENTION

It has now been discovered that the above and other objects of the present invention may be accomplished in the following manner.

Specifically in accordance with the present invention, the above objects are accomplished by providing three additional mounting rails attached to the forward receiver of the M249 with four fixed dowels and two screws. These three rails provide for MIL-STD-1913 mounting rails on the left, right, and underneath the M249 barrel which allow for various accessories to be attached. The bottom rail has an opening which the bipod is retained in the stowed position.

BRIEF DESCRIPTION OF DRAWINGS

The features of the present invention and the manner of attaining them will become apparent, and the invention itself will be understood by reference to the following description and the accompanying drawings. In these drawings, like numerals refer to the same or similar elements. The sizes of the different components in the figures might not be in exact proportion and are shown for visual clarity and for the purpose of explanation.

DETAILED DESCRIPTION

In FIGS. 1–4, the forward mounting rail 1 according to the embodiment of the present invention is depicted.

Figure 1:
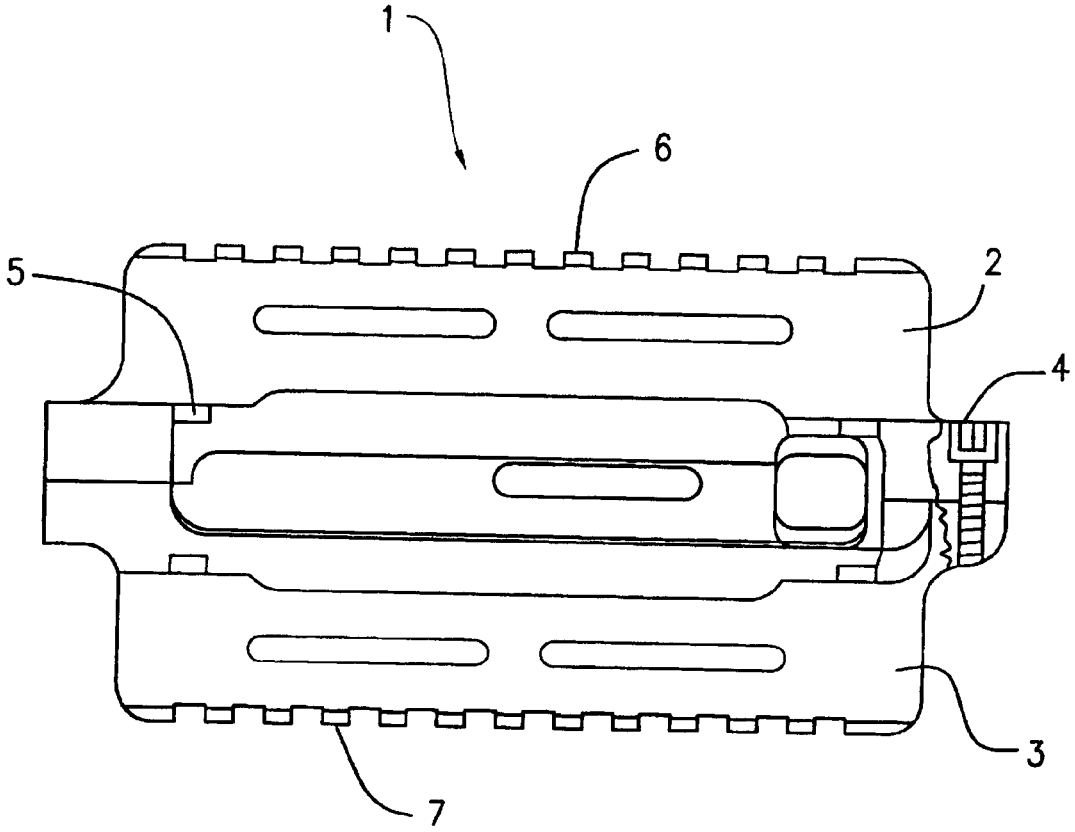
FIG. 1 is a top view of the forward mounting rail assembly.
Figure 2:
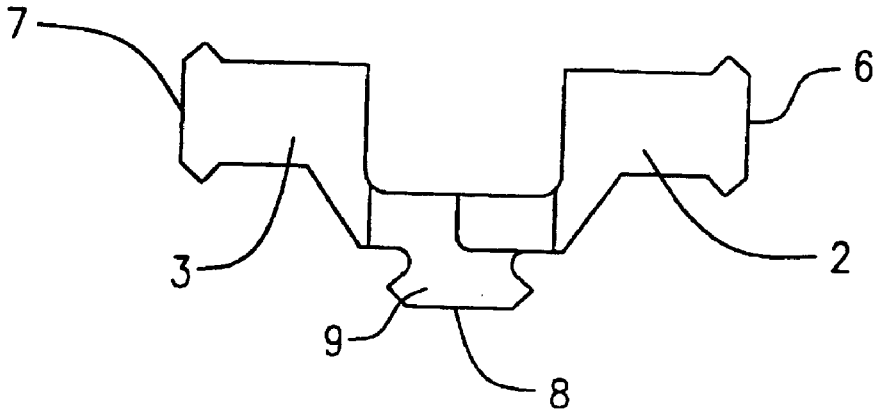
FIG. 2 is a front assembly view of the forward mounting rails.

The forward mounting rail 1 is generally comprised of seven main features. These are: A left mounting rail 2 is shown at FIGS. 1, 2, 4 with integral MIL-STD-1913 rail interface 6 on the side as shown at FIGS. 2, 4; and another MIL-STD-1913 rail interface 8 at the bottom of the forward mounting rail 1 shown at FIGS. 2, 3. This bottom rail 9 at FIG. 2. is formed by the joinder of the left and right mounting rails 2, 3 (two piece base).

Figure 3:
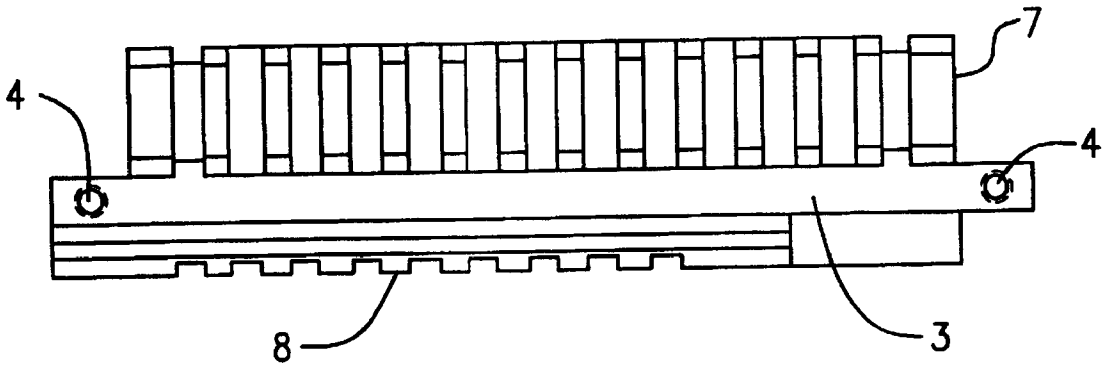
FIG. 3 is a right view of the forward mounting rails.
Figure 4:
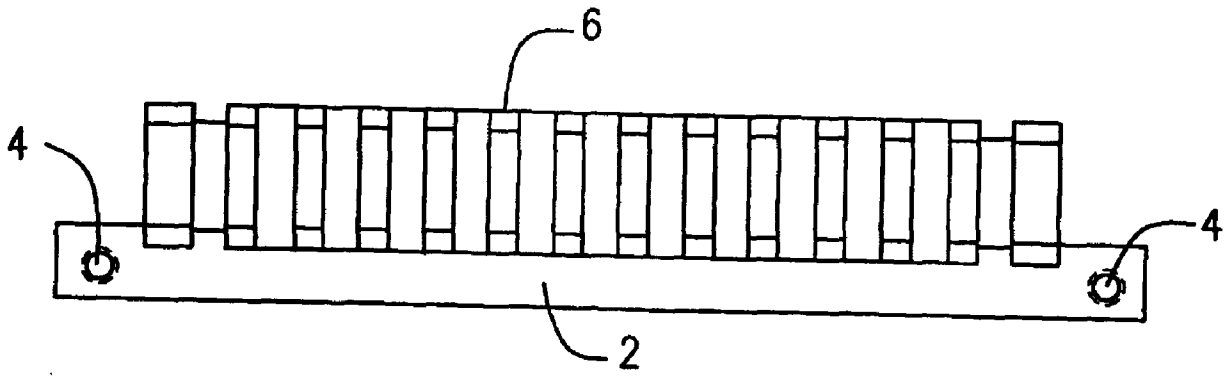
FIG. 4 is a left view of the forward mounting rails.

FIG. 3 shows the right mounting rail 3 with integral MIL-STD-1913 rail interface 7 on the side.

FIGS. 1, 3, 4 depict on the bottom, threaded fasteners 4 (two screw cap, socket head, MS 16997-33L) for retaining the left mounting rail 2 to the right mounting rail 3, and the positioning/mounting dowel pins 5 (Part 12993776) shown at FIG. 1.

The embodiments described herein are included for the purposes of illustration, and are not intended to be exclusive; rather, they can be modified within the scope of the invention. Other modifications may be made when implementing the invention for a particular application.

What is claimed is:

1. A forward mounting rail system for quick connect of an accessory to, and disconnect from an automatic weapon that includes a barrel and a receiver with existing holes, the forward mounting rail system comprising:

a base formed of two pieces and including at least two rails that are mountable onto, and disconnectable from the receiver of the automatic weapon; and a fastener that-interlocks the two pieces of the base, and that fits into the existing holes of the receiver, for securely mounting the base to the receiver without necessitating any modification to the automatic weapon design;

wherein the removal of the fastener allows the base to be disconnected from the automatic weapon; and wherein the removal of the barrel does not disconnect the base from the automatic weapon.

2. The forward mounting rail system of claim 1, wherein the fastener comprises positioning dowel pins.

3. The forward mounting rail system of claim 2, wherein the rails comprise a left mounting rail that is mounted on a left side of the receiver and a right mounting rail that is mounted on a right side of the receiver.

4. The forward mounting rail system of claim 3, wherein the rails further comprise a third mounting rail that is mounted an underside of the receiver.

5. The forward mounting rail system of claim 1, wherein the fastener includes a threaded fastener.

* * * * *